US009964312B2

(12) United States Patent
Deng et al.

(10) Patent No.: US 9,964,312 B2
(45) Date of Patent: May 8, 2018

(54) KITCHEN OVEN

(71) Applicant: Hestan Commercial Corporation, Anaheim, CA (US)

(72) Inventors: Eric Deng, Irvine, CA (US); Chris Moy, Monterey Park, CA (US)

(73) Assignee: Hestan Commercial Corporation, Anaheim, CA (US)

( * ) Notice: Subject to any disclaimer, the term of this patent is extended or adjusted under 35 U.S.C. 154(b) by 178 days.

(21) Appl. No.: 14/968,029

(22) Filed: Dec. 14, 2015

(65) Prior Publication Data

US 2016/0169529 A1 Jun. 16, 2016

Related U.S. Application Data

(60) Provisional application No. 62/091,237, filed on Dec. 12, 2014.

(51) Int. Cl.

| | |
|---|---|
| ***F23M 7/00*** | (2006.01) |
| ***F24C 15/02*** | (2006.01) |
| ***E05F 1/02*** | (2006.01) |
| ***E05F 5/02*** | (2006.01) |
| ***E05F 5/10*** | (2006.01) |

(52) U.S. Cl.

CPC ..... *F24C 15/023* (2013.01); *E05F 1/02* (2013.01); *E05F 5/02* (2013.01); *E05F 5/10* (2013.01); *E05Y 2201/41* (2013.01); *E05Y 2201/422* (2013.01); *E05Y 2800/21* (2013.01); *E05Y 2900/308* (2013.01)

(58) Field of Classification Search

CPC ..... F24C 15/023; E05F 1/02
USPC ..... 126/273 R, 190, 198, 192, 194
See application file for complete search history.

(56) References Cited

U.S. PATENT DOCUMENTS 4,287,873 A * 9/1981 Goins ..... F24C 15/023 126/191
2010/0281650 A1* 11/2010 Kleemann ..... A47L 15/4261 16/64

FOREIGN PATENT DOCUMENTS

EP 2362050 A2 8/2011
EP 2 218 860 B1 10/2014

OTHER PUBLICATIONS

Canadian Office Action dated Feb. 3, 2017 issued in connection with Canadian Application No. 2915048.
http://www.ebay.com/bhp/oven-door-hinge.
Examiner's Report dated Jan. 24, 2018 issued in connection with corresponding Canadian Application No. 2,915,048.

* cited by examiner

*Primary Examiner* — Vivek Shirsat
(74) *Attorney, Agent, or Firm* — Akerman LLP

(57) ABSTRACT

According to one embodiment, an oven includes an oven chamber operable to be heated and having a front opening. The oven further includes a frame coupled to and at least partially surrounding the oven chamber. The oven further includes a door operable to seal the front opening of the oven chamber, and a pair of hinges pivotally coupling the door to the frame. Each hinge is positioned on opposing sides of the oven chamber. The oven further includes a pair counter-weights that are each coupled to the rear portion of a respective hinge, and a pair of dampers. Each damper is coupled to the frame and operable to resist movement of the door in a single direction opposite that of the other damper.

25 Claims, 5 Drawing Sheets

KITCHEN OVEN

CROSS-REFERENCE TO RELATED APPLICATION

This application claims priority to U.S. Provisional Patent Application No. 62/091,237, filed Dec. 12, 2014, the entirety of which is incorporated herein.

TECHNICAL FIELD

This disclosure relates generally to the field of cooking and more specifically to a kitchen oven.

BACKGROUND

Traditionally, ovens include a door that may be opened to add/remove food from the oven, and closed to cook food that has been added to the oven. Such traditional ovens, however, may be deficient.

SUMMARY

A first aspect of the invention is achieved by providing an oven, comprising an oven chamber operable to be heated, the oven chamber having a front opening; a frame coupled to and at least partially surrounding the oven chamber, the frame including a pair of vertical portions each being positioned on opposing lateral sides of the front opening; a door operable to seal the front opening of the oven chamber, the door extending laterally to at least the vertical portions of the frame; a pair of hinges pivotally coupling the door to the frame, the hinges each being positioned on opposing sides of the oven chamber, each hinge having a front portion disposed in-between a front surface and a back surface of the door; and a rear portion that extends rearward away from the door and through an opening in a respective vertical portion of the frame; a pair of counterweights that are each coupled to the rear portion of a respective hinge; and a pair of dampers, each damper coupled to the frame and operable to resist movement of the door in a single direction opposite that of the other damper.

Another aspect of the invention is any such oven, wherein the oven chamber is selected from a group consisting of a gas oven chamber; an electric oven chamber; a wood-burning oven chamber; a charcoal-burning oven chamber; and a convection oven chamber.

Another aspect of the invention is any such oven, wherein a first damper of the pair of dampers is an extension damper.

Another aspect of the invention is any such oven, wherein a second damper of the pair of dampers is a compression damper.

Another aspect of the invention is any such oven, wherein a first damper of the pair of dampers couples a first counterweight of the pair of counterweights to the frame.

Another aspect of the invention is any such oven, further comprising a second pair of dampers, each damper of the second pair of dampers being coupled to the frame and operable to resist movement of the door in a single direction opposite that of the other damper of the second pair of dampers, a first damper of the second pair of dampers coupling a second counterweight of the pair of counterweights to the frame.

Another aspect of the invention is any such oven, wherein each damper of the pair of dampers is positioned on the same side of the oven chamber.

Another aspect of the invention is any such oven, wherein each damper of the pair of dampers is positioned on opposing sides of the oven chamber.

Another aspect of the invention is any such oven, wherein the pair of counterweights have a combined weight that is approximately equal to a weight of the door.

Another aspect of the invention is any such oven, wherein the front portion of each hinge is positioned orthogonal to the rear portion.

A second aspect of the invention is achieved by performing a method, comprising coupling a frame to an oven chamber so that the frame at least partially surrounds the oven chamber, the oven chamber being operable to be heated, the oven chamber having a front opening, the frame having a pair of vertical portions that are each positioned on opposing lateral sides of the front opening; pivotally coupling a door to the frame using a pair of hinges, the door being operable to seal the front opening of the oven chamber, the door extending laterally to at least the vertical portions of the frame, the hinges each being positioned on opposing sides of the oven chamber, each hinge having a front portion disposed in-between a front surface and a back surface of the door; and a rear portion that extends rearward away from the door and through an opening in a respective vertical portion of the frame; coupling each of a pair of counterweights to the rear portion of a respective hinge; and coupling a pair of dampers to the frame, each damper being operable to resist movement of the door in a single direction opposite that of the other damper.

Another aspect of the invention is any such method, wherein the oven chamber is selected from a group consisting of a gas oven chamber; an electric oven chamber; a wood-burning oven chamber; a charcoal-burning oven chamber; and a convection oven chamber.

Another aspect of the invention is any such method, wherein a first damper of the pair of dampers is an extension damper.

Another aspect of the invention is any such method, wherein a second damper of the pair of dampers is a compression damper.

Another aspect of the invention is any such method, further comprising coupling a first counterweight of the pair of counterweights to the frame using a first damper of the pair of dampers.

Another aspect of the invention is any such method, further comprising coupling a second pair of dampers to the frame, each damper of the second pair of dampers being operable to resist movement of the door in a single direction opposite that of the other damper of the second pair of dampers; and coupling a second counterweight of the pair of counterweights to the frame using a first damper of the second pair of dampers.

Another aspect of the invention is any such method, wherein each damper of the pair of dampers is positioned on the same side of the oven chamber.

Another aspect of the invention is any such method, wherein each damper of the pair of dampers is positioned on opposing sides of the oven chamber.

Another aspect of the invention is any such method, wherein the pair of counterweights have a combined weight that is approximately equal to a weight of the door.

A third aspect of the invention is achieved by providing an oven, comprising an oven chamber operable to be heated, the oven chamber having a front opening; a frame operatively coupled to support and at least partially surround the oven chamber; a door operable to seal the front opening of the oven chamber, the door extending laterally to at least a pair of vertical portions of the frame; a pair of hinges pivotally coupling the door to the frame, the hinges each being positioned on opposing sides of the oven chamber and in-between respective side portions of the frame and the oven chamber, each hinge having a front portion disposed in-between a front surface and a back surface of the door; and a rear portion that extends rearward away from the door and through an opening in a respective vertical portion of the frame; a first counterweight coupled to the rear portion of a first hinge of the pair of hinges; and a first damper coupled to the frame and operable to resist movement of the door in at least a first direction.

Another aspect of the invention is any such oven, further comprising a second counterweight coupled to the rear portion of a second hinge of the pair of hinges.

Another aspect of the invention is any such oven, further comprising a second damper coupled to the frame and operable to resist movement of the door in a direction opposite of that resisted by the first damper.

Another aspect of the invention is any such oven, wherein the first damper and the second damper are each disposed in-between a side portion of the frame and the oven chamber.

Another aspect of the invention is any such oven, wherein the first damper is an extension damper pivotally coupled to a portion of the frame and a portion of at least one of the first counterweight and the rear portion of the first hinge of the pair of hinges, and wherein the second damper is a compression damper.

Another aspect of the invention is any such oven, wherein the extension damper and compression damper are disposed on the same side of the oven chamber.

Another aspect of the invention is any such oven, wherein the first damper is disposed in-between a side portion of frame and the oven chamber.

Another aspect of the invention is any such oven, wherein the first damper is an extension damper pivotally coupled to a portion of the frame and a portion of at least one of the first counterweight and the rear portion of the first hinge of the pair of hinges.

A fourth aspect of the invention is achieved by providing an oven, comprising an oven chamber operable to be heated, the oven chamber having a front opening; a frame coupled to the oven chamber, the frame having a pair of vertical portions that are each positioned on opposing lateral sides of the front opening, the vertical portions extending upward, the frame further having a pair of horizontal portions that are each coupled to a respective vertical portion, the horizontal portions each being positioned on opposing sides of the oven chamber at a location adjacent a bottom of the oven chamber, the horizontal portions extending rearward; a door operable to seal the front opening of the oven chamber, the door extending laterally to at least the vertical portions of the frame; a pair of hinges pivotally coupling the door to the frame, the hinges each being positioned on opposing sides of the oven chamber, each hinge having a front portion disposed in-between a front surface and a back surface of the door; and a rear portion that extends rearward away from the door and through an opening in a respective vertical portion of the frame; a pair of counterweights that are each coupled to the rear portion of a respective hinge; and a pair of dampers, each damper coupled to the frame and operable to resist movement of the door in a single direction opposite that of the other damper.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Figure 1A:
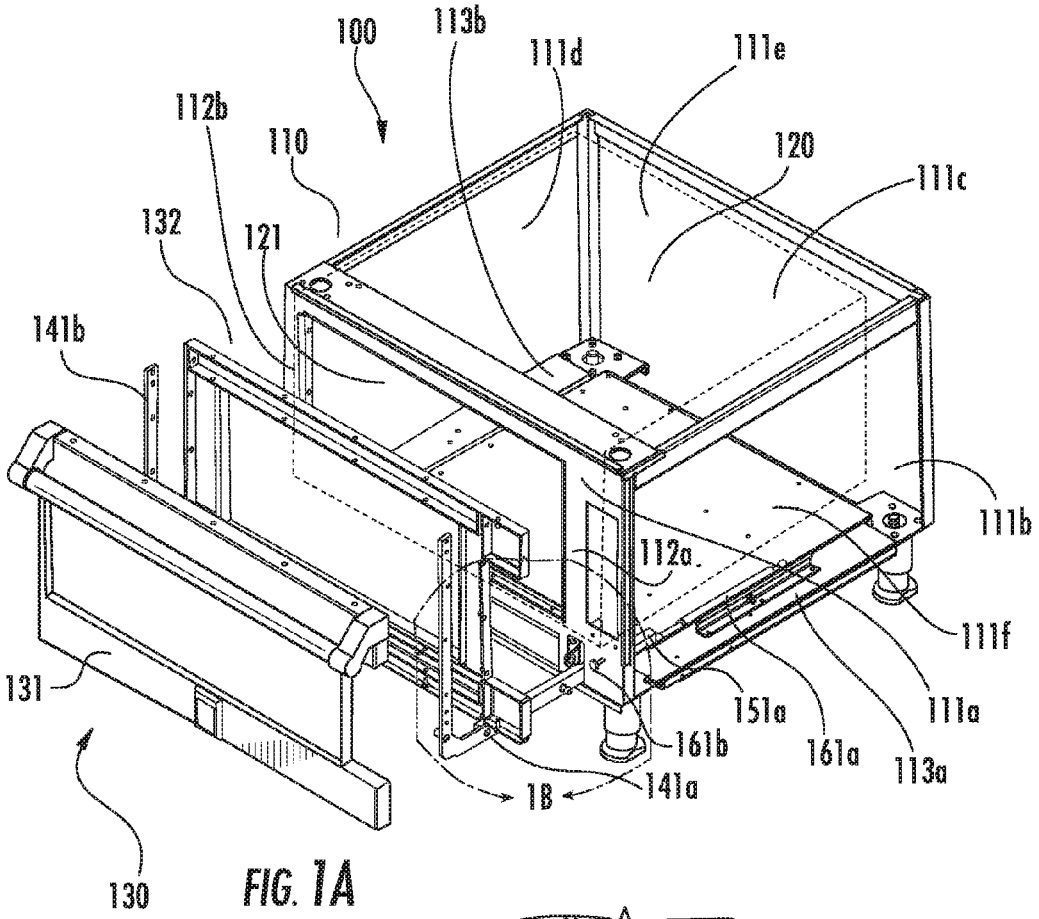
FIGS. 1A-1E illustrate an example kitchen oven.
Figure 1B:
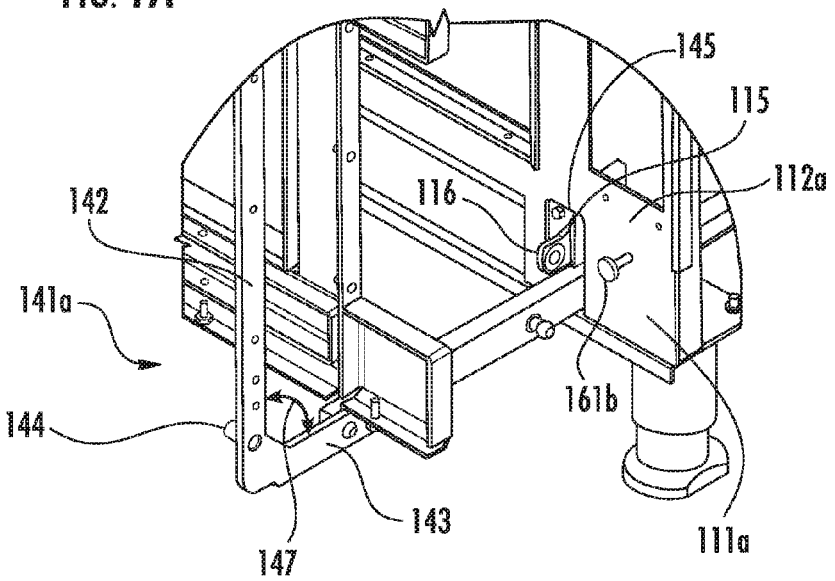
Figure 1C:
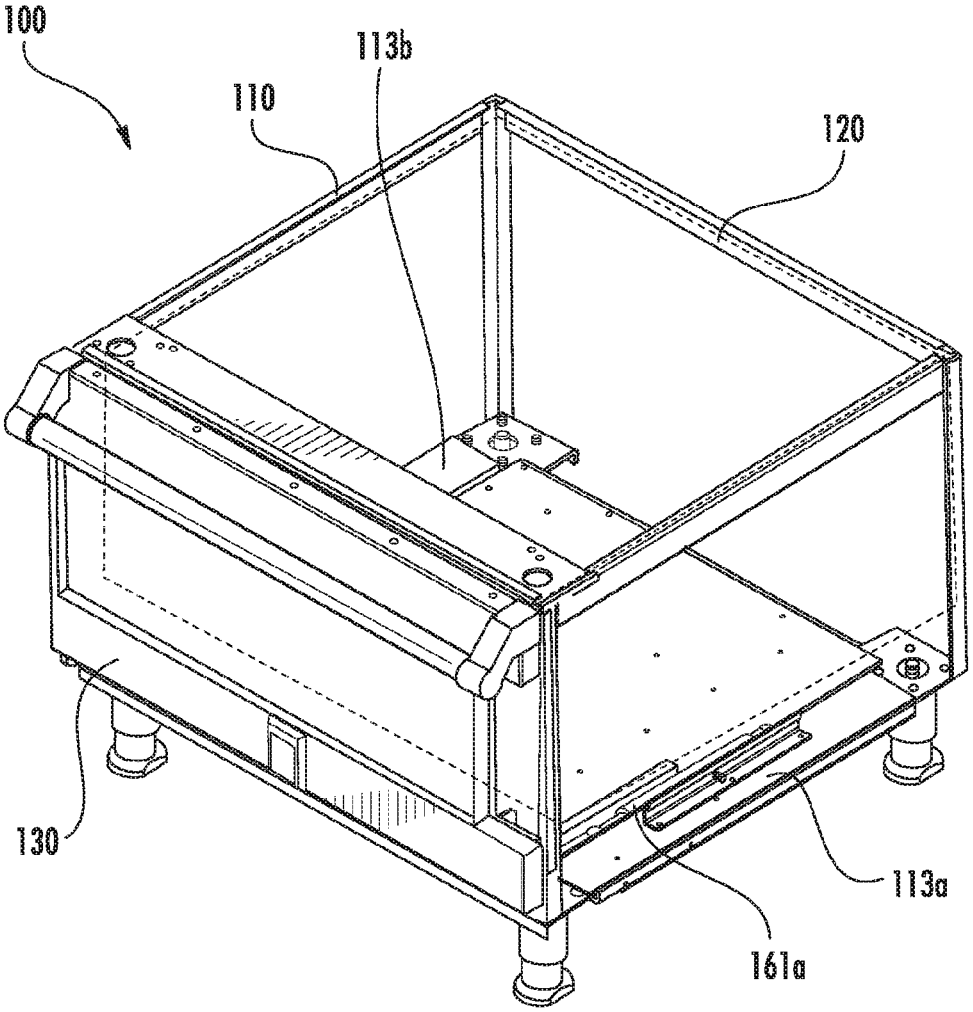
Figure 1D:
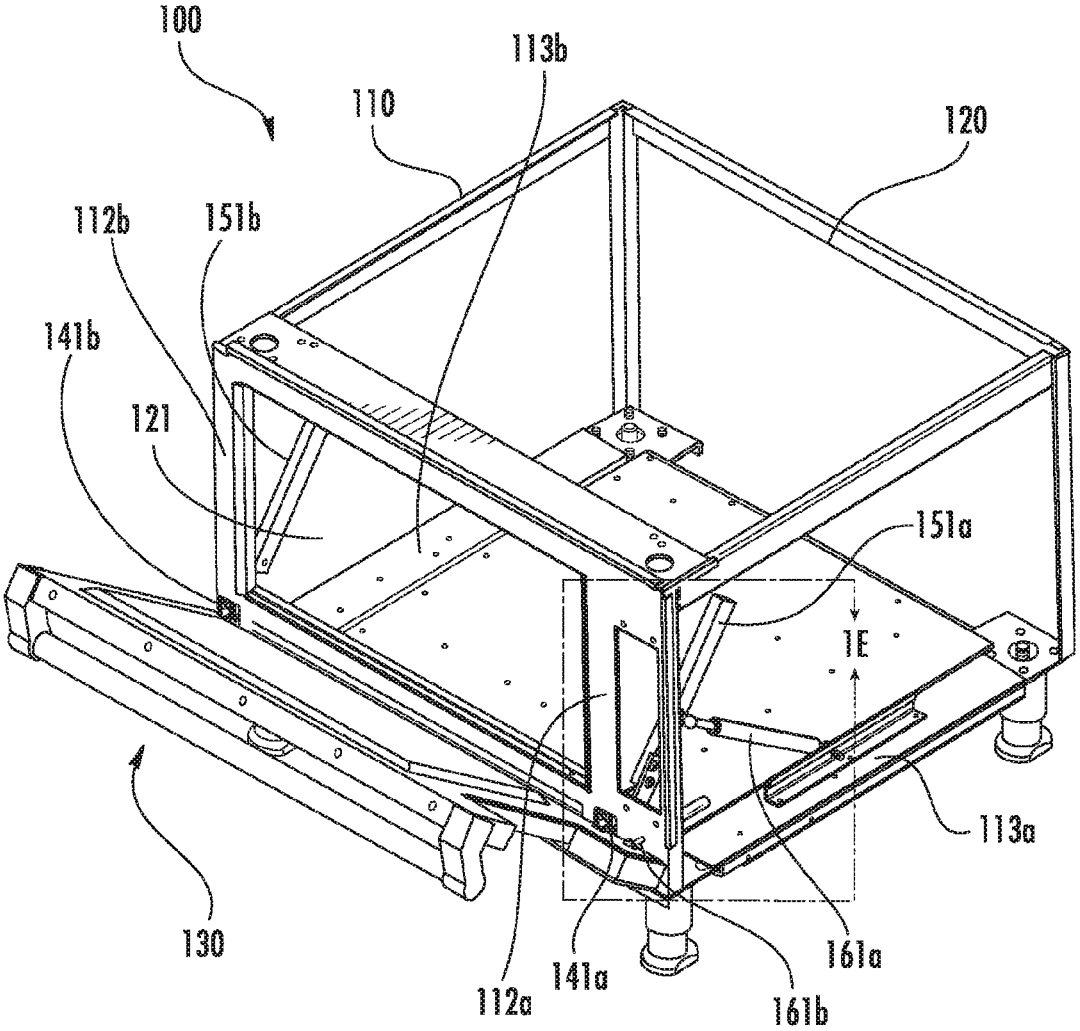
Figure 1E:
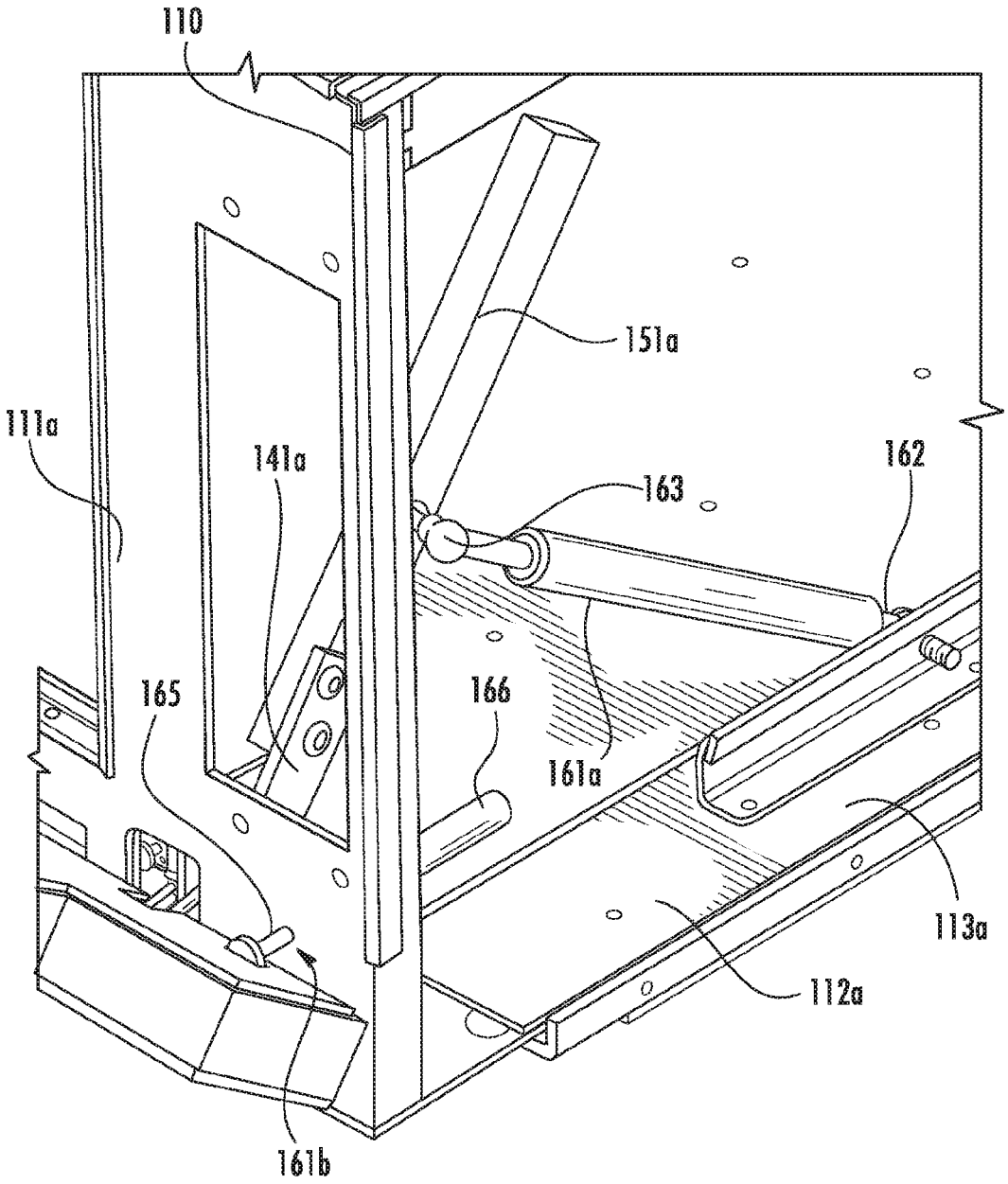
Figure 2:
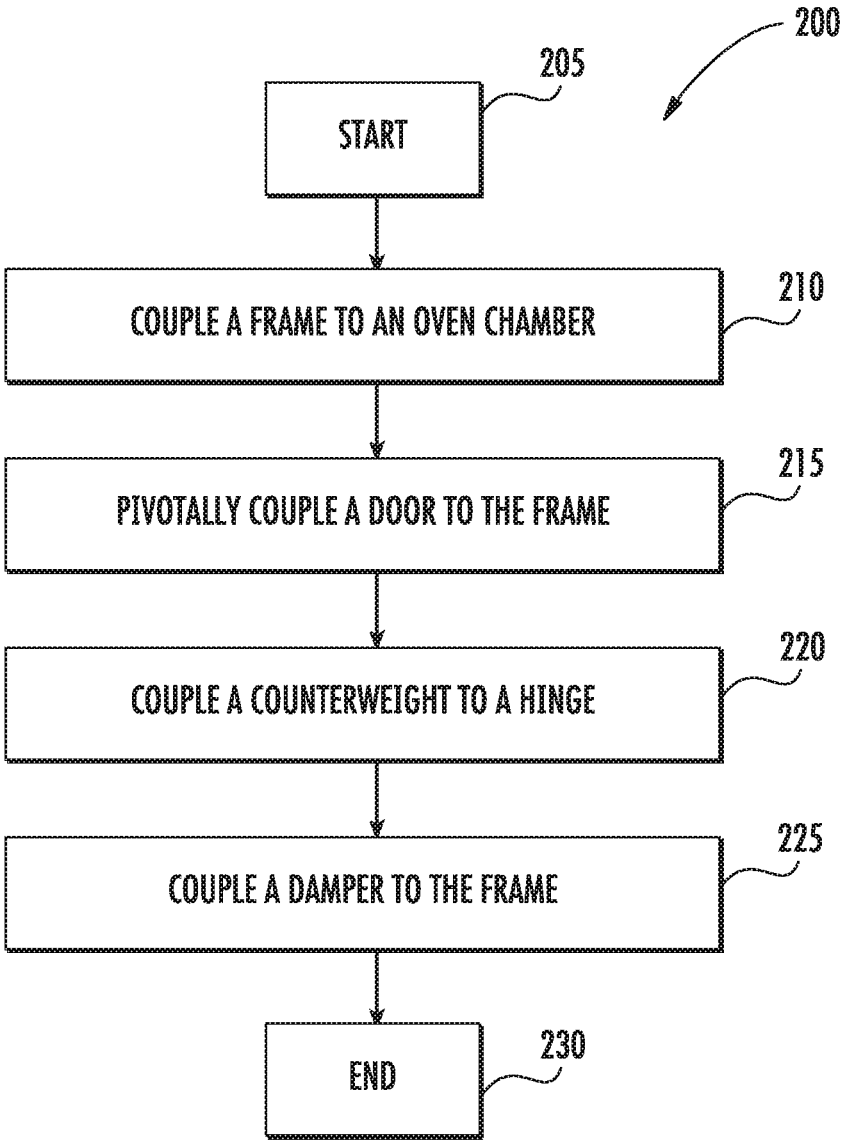
FIG. 2 illustrates an example method of manufacturing, installing, and/or using a kitchen oven.

Embodiments of the present disclosure are best understood by referring to FIGS. 1-2 of the drawings, like numerals being used for like and corresponding parts of the various drawings.

Traditionally, ovens include a door that may be opened to add/remove food from the oven, and closed to cook food that has been added to the oven. Such traditional ovens, however, may be deficient. For example, traditional ovens in the food service industry may have doors without any mechanisms to control the motion or speed of the door. As such, the doors in such traditional ovens may slam open or shut. As another example, traditional residential ovens may have mechanisms to control the motion or speed of the door, but these mechanisms are deficient. In particular, if these mechanisms break, the door may no longer work until the mechanisms are fixed or replaced. Furthermore, even when the mechanisms are working, they may be unable to handle the stress loads required in the food service industry. For example, the food service industry may utilize ovens with oven doors that may need to withstand 400 pounds of weight, so that dishes can be stacked on the oven door and/or so that kitchen personnel may stand on the oven door to reach high up shelving units. Contrary to such typical deficiencies, the oven 100 of FIGS. 1A-1E may provide one or more advantages.

FIGS. 1A-1E illustrate an example kitchen oven. In particular, FIG. 1A illustrates an exploded perspective view of the oven 100 with a door 130; FIG. 1B illustrates an enlarged view of reference portion A in FIG. 1A; FIG. 1C illustrates a perspective view of the oven 100 with the door 130 closed; FIG. 1D illustrates a perspective view of the oven 100 with the door 130 open; and FIG. 1E illustrates an enlarged view of reference portion B in FIG. 1D. As illustrated, the oven 100 includes an oven chamber 120, a frame 110 coupled to the oven chamber 120, and a door 130 coupled to the frame 110. Furthermore, the oven 100 may include dampers 161. The dampers 161 may control the motion or speed of the door 130. As such, the dampers 161 may slow down the speed of the door 130 as it is opening and/or closing, which may prevent the door 130 from slamming open or shut.

As is illustrated in FIGS. 1A-1E, the oven 100 includes an oven chamber 120 (illustrated in broken lines). An oven chamber 120 may be any chamber that may be heated. For example, the oven chamber 120 may be a gas oven chamber, an electric oven chamber, a wood-burning oven chamber, a charcoal-burning oven chamber, any other solid fuel-burning oven chamber, a convection oven chamber, a chamber that may be heated using any other burnable or heat able substance, fuel, or energy source, any other chamber that may be heated, or any combination of the preceding.

The oven 100 may include any number of oven chambers 120. For example, the oven 100 may include 1 oven chamber 120, 2 oven chambers 120, 3 oven chambers 120, 4 oven chambers 120, or any other number of oven chambers 120. Furthermore, the oven chambers 120 may be positioned in any location with respect to each other in the oven 100. For example, the oven chambers 120 may be side-by-side horizontally, side-by-side vertically, side-by-side horizontally and vertically, diagonal to each other, or positioned in any other location with respect to each other. As illustrated, the oven 100 includes a single oven chamber 120

The oven chamber 120 may have any shape. For example, the oven chamber 120 may have a side or cross-section that is shaped as a rectangle, a square, a triangle, a circle, an oval, an irregular shape, any other shape, or any combination of the preceding. As illustrated, the oven chamber 120 has a cross-section that is shaped as a rectangle. The oven chamber 120 may further have any size. For example, the oven chamber 120 may have a capacity size of 2 cubic feet, 3 cubic feet, 4 cubic feet, 5 cubic feet, 6 cubic feet, 7 cubic feet, 8 cubic feet, 10 cubic feet, 12 cubic feet, 15 cubic feet, 20 cubic feet, or any other size. The oven chamber 120 may be made of any material. For example, the oven chamber 120 may be made of steel, stainless steel, aluminum, iron, brass, cast-iron, any other metal or metal alloy (including coated, plated and clad metal), any insulated metal or metal alloy, any metal or metal alloy lined with a refractory material (such as cement, brick, or clay), any other material, or any combination of the preceding.

As illustrated, the oven chamber 120 includes a front opening 121 that may allow food to be inserted and/or removed from the oven chamber 120. The front opening 121 may have any shape and/or size for insertion and/or removal of food from the oven chamber 120.

As illustrated in FIGS. 1A-1E, the oven 100 further includes a frame 110. The frame 110 may be any support structure for the oven chamber 120. For example, the frame 100 may be any structure that generally surrounds and supports all or a portion of the oven chamber 120 (including any heating elements and sidewalls). Furthermore, the frame 110 may have multiple parts. For example, as illustrated, the frame 110 includes a front surface 111*a*, a back surface 111*c*, two side surfaces 111*b* and *d*, a top surface 111*e*, and a bottom surface 111*f*. The surfaces 111 may be coupled to each other to form the frame 110. The surfaces 111 may be coupled to each in any manner. For example, the surfaces 111 may be bolted to each other, screwed to each other, riveted to each other, clipped to each other, welded to each other, formed integral with each other, coupled to each other in any other manner, or any combination of the preceding.

The surfaces 111 of the frame 110 may encapsulate the oven chamber 120, so that the oven chamber 120 may be disposed entirely within the frame 110. Although the surfaces 111 of the frame 110 may encapsulate the oven chamber 120, the front opening 121 of the oven chamber 120 may remain unblocked by the surfaces 111 of the frame 110. Furthermore, the frame 110 (and the surfaces 111) may be coupled to the oven chamber 120 disposed entirely within the frame 110. The frame 110 may be coupled to the oven chamber 120 in any manner. For example, the frame 110 may be bolted to the oven chamber 120, screwed to the oven chamber 120, riveted to the oven chamber 120, clipped to the oven chamber 120, welded to the oven chamber 120, formed integral with the oven chamber 120, coupled to the oven chamber 120 in any other manner, or any combination of the preceding.

The surfaces 111 of the frame 110 may have any shape. For example, a surface 111 may be shaped as a rectangle, a square, a circle, an irregular shape, any other shape, or any combination of the preceding. The surfaces 111 of the frame 110 may also have any size. For example, the surfaces 111 may have a size big enough to encapsulate the oven chamber 120. The surfaces 111 of the frame 110 may be made of any material. For example, a surface 111 may be made of steel, stainless steel, aluminum, iron, brass, cast-iron, any other metal or metal alloy (including coated, plated and clad metal), any insulated metal or metal alloy, any metal or metal alloy lined with a refractory material (such as cement, brick, or clay), any other material, or any combination of the preceding.

As illustrated, the front surface 111*a* may include multiple parts. For example, the front surface 111*a* may include vertical portions 112*a* and 112*b*. Vertical portions 112 may be portions of the front surface 111*a*. For example, the front surface 111*a* may be a surface that includes portions identified as vertical portions 112*a* and 112*b*. Alternatively, the vertical portions 112 may be additional reinforcements that may be added to the front surface 111*a*. For example, the vertical portions 112 may be additional sections of steel (or any other material discussed above, for example) that are coupled to a portion (or all of) the front surface 111*a* in order to reinforce portions (or all) of the front surface 111*a*.

The vertical portions 112 may be positioned in any manner. For example, as is illustrated, the vertical portions 112 may be positioned on opposing lateral sides of the front opening 121. The vertical portions 112 may also extend upward along the front surface 111*a* of the frame 110, as is also illustrated. The vertical portions 112 may extend upward for all (or a portion) of the height of the frame 110. Additionally, the vertical portions 112 may also extend horizontally, so as to wrap around onto additional surfaces. In such an example, the vertical portions 112 may wrap around onto top surface ille and/or bottom surface 111*f*, as is illustrated in FIG. 1A.

As is also illustrated, the bottom surface 111*f* may include multiple parts. For example, the bottom surface 111*f* may include horizontal portions 113*a* and 113*b*. Horizontal portions 113 may be portions of the bottom surface 111*f*. For example, the bottom surface 111*f* may be a surface that includes portions identified as horizontal portions 113*a* and 113*b*. Alternatively, horizontal portions 113 may be additional reinforcements that may be added to the bottom surface 111*f*. For example, horizontal portions 113 may be additional sections of steel (or any other material discussed above, for example) that are coupled to a portion (or all of) the bottom surface 111*f* in order to reinforce portions (or all) of the bottom surface 111*f*.

The horizontal portions 113 may be positioned in any manner. For example, as is illustrated, the horizontal portions 113 may be positioned within the frame 110 on opposing sides of the oven chamber 120. Additionally, as a result of the horizontal portions 113 being a portion of the bottom surface 111*f* (or as a result of the horizontal portions 113 reinforcing all or a portion of the bottom surface 111*f*), the horizontal portions 113 may be located adjacent the bottom of the oven chamber 120. Furthermore, the horizontal portions 113 may be coupled to the vertical portions 112. For example, the horizontal portion 113*a* may be coupled to the vertical portion 112*a*, and the horizontal portion 113*b* may be coupled to the vertical portion 112*b*. The horizontal portions 113 may be coupled to the vertical portions 112 in any manner. For example, the horizontal portions 113 may be bolted to the vertical portions 112, screwed to the vertical portions 112, riveted the vertical portions 112, clipped the vertical portions 112, welded the vertical portions 112, formed integral with the vertical portions 112, coupled the vertical portions 112 in any other manner, or any combination of the preceding. The horizontal portions 113 may also extend rearward along the bottom surface 111*f* of the frame 110, as is also illustrated. The horizontal portions 113 may extend rearward for all (or a portion) of the depth of the frame 110.

As illustrated, the oven 100 further includes a door 130. A door 130 may be any structure that may seal the front opening 121 of the oven chamber 120. This sealing of the front opening 121 may prevent at least a portion of the heat in the oven chamber 120 from escaping the oven chamber 120, and may further prevent at least a portion of the cooler air outside of the oven chamber 120 from entering the oven chamber 120. In addition to sealing the oven chamber 120, the door 130 may further be opened and closed to allow food to be inserted into and/or removed from the oven chamber 120. The door 130 may be opened and closed in any manner. For example, the door 130 may be opened by pivoting the door 130 downward, and closed by pivoting the door upward (as is illustrated in FIG. 1D).

The oven 100 may include any number of doors 130. For example, the oven 100 may include 1 door 130, 2 doors 130, 3 doors 130, 4 doors 130, or any other number of doors 130. The number of doors 130 included on the oven 100 may be based on the number of oven chambers 120 included in the oven 100. For example, the oven 100 may include 1 door 130 for every 1 oven chamber 120 included in the oven 100. As another example, the oven 100 may include 1 door 130 for every 2 oven chambers 120 included in the oven. In such an example, the 2 oven chambers 120 may share the same door 130. The doors 130 may be positioned in any location with respect to each other in the oven 100. For example, the doors 130 may be side-by-side horizontally, side-by-side vertically, side-by-side horizontally and vertically, diagonal to each other, or positioned in any other location with respect to each other. As illustrated, the oven 100 includes a single door 130.

The door 130 may have any shape. For example, the door 130 may be shaped as a rectangle, a square, a triangle, a circle, an oval, an irregular shape, any other shape, or any combination of the preceding. As illustrated, the door 130 is shaped generally as a rectangle. The door 130 may further have any size. For example, the door 130 may be sized to cover all of the front surface 111*a*. As another example, the door 130 may be sized to cover all of the front opening 121 of oven chamber 120. In such an example, the door 130 may extend laterally to at least the vertical portions 112 of the front surface 111*a* of the frame 100, thereby covering the lateral edges of the front opening 121. Furthermore, the door 130 may also extend vertically to at least cover the bottom and top edges of the front opening 121. The door 130 may be made of any material. For example, the door 130 may be made of steel, stainless steel, aluminum, iron, brass, cast-iron, any other metal or metal alloy (including coated, plated and clad metal), any insulated metal or metal alloy, any metal or metal alloy lined with a refractory material (such as cement, brick, or clay), any other material, or any combination of the preceding.

As is also illustrated, the door 130 may include multiple parts. For example, the door 130 may include a door front surface 131 and a door back surface 132. The door front surface 131 and the door back surface 132 may be coupled together to form the door 130. Additionally, a portion of hinges 141 (discussed below) may be disposed in-between the door front surface 131 and the door back surface 132, thereby coupling the hinges 141 to the door 130.

As illustrated, the oven 100 further includes hinges 141. A hinge 141 may be any structure that may couple the door 130 to the frame 110, and that may further allow the door 130 to be opened and/or closed. For example, the hinge 141 may be coupled to the frame 110 in a manner that allows the hinge 141 to pivot around an axis. In such an example, the hinge 141 may pivotally couple the door 130 to the frame 110. The hinge 141 may allow the door to be opened and/or closed in any manner.

The oven 100 may include any number of hinges 141. For example, the oven 100 may include 1 hinge 141, 2 hinges 141, 3 hinges 141, 4 hinges 141, or any other number of hinges 141. The number of hinges 141 included on the oven 100 may be based on the number of doors 130 included on the oven 100. For example, the oven 100 may include 1 hinge 141 for every 1 door 130 included on the oven 100. As another example, the oven 100 may include 2 hinges 141 for every 1 door 130 included on the oven 130. As illustrated, the oven 100 includes two hinges 141 coupled to the door 130, and positioned on opposing sides of the oven chamber 120.

The hinge 141 may have any shape and/or size. Additionally, the hinge 141 may be made of any material. For example, the hinge 141 may be made of steel, stainless steel, aluminum, iron, brass, any other metal or metal alloy, any insulated metal or metal alloy, plastic, any other material, or any combination of the preceding.

As is also illustrated, the door hinge 141 may include multiple parts. For example, the hinge 141 may include a front portion 142, a rear portion 143, and a pivoting portion 144, as is illustrated in FIG. 1B. The front portion 142 may be disposed in-between the door front surface 131 and the door rear surface 132, so as to be coupled to the door 130. As such, the front portion 142 may couple the door 130 to the hinge 141. The front portion 142 may be coupled to the door 130 (thereby coupling the door 130 to the hinge 141) in any manner. For example, the front portion 142 may be bolted to the door 130, screwed to the door 130, riveted to the door 130, clipped to the door 130, welded to the door 130, formed integral with the door 130, inserted into one or more brackets included within the door 130, coupled to the door 130 in any other manner, or any combination of the preceding.

The rear portion 143 of the hinge 141 may extend rearward away from the door 130 (and the front portion 142). Furthermore, the rear portion 143 may extend rearward through an opening 145 in the vertical portions 112, as is illustrated in FIG. 1B. As such, the rear portion 143 may extend into the frame 110 of the oven 100. The pivoting portion 144 of the hinge 141 may couple the hinge 141 to the frame 110 (thereby coupling the door 130 to the frame 110). For example, the pivoting portion 144 may be an axle or pin such as a vertical axle) that may be inserted into a matching bore 116 in a tab 115 of the opening 145 of the front surface 111*a*, as is illustrated in FIG. 1B. Insertion of the pivoting portion 144 into the matching bore 116 may allow the hinge 141 to pivot around an axis of the matching bore 116. As such, the door 130 (and the hinge 141) may pivot downward in order for the door 130 to be opened, and the door 130 (and the hinge 141) may pivot upward in order for the door 130 to be closed.

The front portion 142 and the rear portion 143 may be positioned in any configuration with regard to each other. For example, the front portion 142 may be positioned at an angle 147 to the rear portion 143. The angle 147 may be any angle. For example, the angle 147 may be 90 degrees (i.e., orthogonal), 80 degrees, 70 degrees, 45 degrees, 100 degrees, 110 degrees, 135 degrees, or any other angle. As another example, the angle 147 may be approximately (i.e., +/−5 degrees) 90 degrees (i.e., approximately orthogonal), approximately 80 degrees, approximately 70 degrees, approximately 45 degrees, approximately 100 degrees, approximately 110 degrees, approximately 135 degrees, or approximately any other angle. As is illustrated, the front portion 142 is positioned at an angle 147 of 90 degrees (i.e., orthogonal) to the rear portion 143.

The pivoting portion 144 may be positioned in any configuration with regard to the front portion 142 and the rear portion 143. For example, the pivoting portion 144 may be positioned on the front portion 142, the rear portion 143, or a combination of both the front portion 142 and the rear portion 143.

The front portion 142, the rear portion 143, and the pivoting portion 144 may be coupled to each other to form the hinge 141. The front portion 142, the rear portion 143, and the pivoting portion 144 may be coupled to each other in any manner. For example, the front portion 142, the rear portion 143, and the pivoting portion 144 may be bolted to each other, screwed to each other, riveted to each other, clipped to each other, welded to each other, formed integral with each other, coupled to each other in any other manner, or any combination of the preceding.

As illustrated, the oven 100 further includes counterweights 151. A counterweight 151 may be any weighted structure that may be coupled to the hinges 141. The counterweight 151 may assist the door 130 in opening and/or closing. For example, when the door 130 is partially open (such as more than 50% open), the weight of the counterweight 151 may provide a turning moment about the hinges 141 to complete the opening of the door 130. As such, the counterweight 151 may complete the opening of the door 130 without any additional pressure being applied by a user. As another example, when the door 130 is partially closed (such as more than 50% closed), the weight of the counterweight 151 may provide a turning moment about the hinges 141 to complete the closing of the door 130. As such, the counterweight 151 may complete the closing of the door 130 without any additional pressure being applied by a user.

The counterweight 151 and/or the rear portion 143 of the hinge 141 may further prevent the door 130 from being opened too far. For example, when the door 130 is fully opened, the counterweight 151 and/or the rear portion 143 of the hinge 141 may be positioned against a back side of the front surface 111*a* of the frame 110 (as a result of the counterweight 151 and the rear portion 143 of the hinge 141 pivoting upward). The strength of the frame 110 at this contact point (in addition to the strength of the counterweight 151 and/or the strength of the rear portion 143 of the hinge 141) may prevent the counterweight 151 (and the rear portion 143 of the hinge 141) from pivoting upward any further because such movement may be blocked by the back side of the front surface 111*a*. As such, the door 130 may be prevented from being opened any further.

Furthermore, this positioning of the counterweight 151 (and the strength of the front surface 111*a*) may prevent the door 130 from being forced further past the fully open position even when, for example, 400 pounds of weight (or more) is positioned on the door 130. As such, the door 130 (and the hinge 141) may have the strength to be used in the food service industry. The door 130 may be fully opened when it is positioned at (or opened to) any angle to the front surface 111*a* of the frame 110. For example, the door 130 may be fully opened when the door 130 is positioned at (or opened to) an angle of 90 degrees (i.e., a horizontal orientation) to the front surface 111*a* of the frame 110, an angle of 80 degrees to the front surface 111*a* of the frame 110, an angle of 110 degrees to the front surface 111*a* of the frame 110, or any other angle. As another example, the door 130 may be fully opened when the door 130 is positioned at (or opened to) an angle of approximately (i.e., +/−5 degrees) 90 degrees (i.e., approximate horizontal orientation) to the front surface 111*a* of the frame 110, an angle of approximately 80 degrees to the front surface 111*a* of the frame 110, an angle of approximately 110 degrees to the front surface 111*a* of the frame 110, or any other approximate angle.

The oven 100 may include any number of counterweights 151. For example, the oven 100 may include 1 counterweight 151, 2 counterweights 151, 3 counterweights 151, 4 counterweights 151, or any other number of counterweights 151. The number of counterweights 151 included on the oven 100 may be based on the number of hinges 141 included on the oven 100. For example, the oven 100 may include 1 counterweight 151 for every 1 hinge 141 included on the oven 100. As another example, the oven 100 may include 1 counterweight 151 for every 2 hinges 141 included on the oven 130. As illustrated, the oven 100 includes two counterweights 151 positioned on opposing sides of the oven chamber 120, with each counterweight 151 coupled to opposing hinges 141.

The counterweight 151 may have any shape and/or size. In one example, the counterweight is preferably sized to fit in-between the oven chamber 120 and the frame 110. Additionally, the counterweight 151 may have any weight. For example, the combination of all counterweights 151 included on the oven 100 may be equal to the weight of the door 130. As another example, the combination of all counterweights 151 included on the oven 100 may be approximately (i.e., +/−5 pounds) equal to the weight of the door 130. Each counterweight 151 included on the oven 100 may have the same weight, or one or more counterweights 151 included on the oven 100 may have different weights. Furthermore, the counterweight 151 may be made of any material. For example, the counterweight 151 may be made of steel, stainless steel, aluminum, iron, cast-iron, lead, brass, any other metal or metal alloy, including plated, coated and clad metal and any insulated metal or metal alloy, any other material, or any combination of the preceding.

The counterweight 151 may be coupled to the hinge 141. For example, as is illustrated, the counterweight 151*a* may be coupled to the hinge 141*a*, and the counterweight 151*b* may be coupled to the hinge 141*b*. The counterweight 151 may be coupled to the hinge 141 in any manner. For example, the counterweight 151 may be bolted to the hinge 141, screwed to the hinge 141, riveted to the hinge 141, clipped to the hinge 141, welded to the hinge 141, formed integral with the hinge 141, coupled to the hinge 141 in any other manner, or any combination of the preceding. Additionally, the counterweight 151 may be coupled to any portion of the hinge 141. For example, the counterweight 151 may be coupled to the rear portion 143 of the hinge 141, as is illustrated. Furthermore, the counterweight 151 may be coupled to the rear portion 143 at a location on the rear portion 143 that causes the counterweight 151 to be located inside of the frame 110. It should be appreciated that the center of gravity of the combination of the counterweight 151 and the hinge 141 can be modified by changing the size and/or shape of either member so that the door 130 may self-open and self-close at predetermined angles, taking into account the center of gravity of the door 130.

As illustrated, the oven 100 further includes dampers 161. A damper 161 may be any device or mechanism that may control the motion or speed of the door 130 as the door 130 is being opened and/or closed. For example, the damper 161 may be an extension damper that controls speed when the rod of the damper 161 is being extended out of the tube of the damper 161, a compression damper that controls speed when the rod of the damper 161 is being compressed into the tube of the damper 161, a dual direction damper that controls speed when the rod of the damper 161 is both being extended out of the tube of the damper 161 and being compressed into the tube of the damper 161, any other device or mechanism that may control the motion or speed of the door 130 as the door 130 is being opened and/or closed, or any combination of the preceding. Furthermore, the damper 161 may operate in any manner (or include any components) to control the motion or speed of the door 130 as the door 130 is being opened and/or closed. For example, the damper 161 may be a hydraulic damper, a spring-operated damper, an air-filled dash pot damper, a damper that may operate in any other manner (or include any other components) to control the motion or speed of the door 130 as the door 130 is being opened and/or closed, or any combination of the preceding. The damper 161 may have any shape and/or size. Additionally, the damper 161 may have any maximum/minimum load.

As is discussed above, the damper 161 may control the motion or speed of the door 130 as the door 130 is being opened and/or closed. As such, the damper 161 may slow down the speed of the door 130 as it is opening and/or closing, which may prevent the door 130 from slamming open or shut. The damper 161 may control the motion or speed of the door 130 by resisting movement of the door 130. For example, the damper 161 may resist movement of the door 130 in a direction of the opening of the door 130 (thereby preventing the door 130 from slamming open), in a direction of the closing of the door 130 (thereby preventing the door 130 from slamming shut), or in both the direction of the opening of the door 130 and the direction of the closing of the door 130 (thereby preventing the door 130 from slamming open or shut).

The damper 161 may be designed to fail in a mode (or manner) that does not preclude opening and/or closing of the door 130, for example. Alternatively (or additionally), the oven 100 may include multiple redundant dampers 161 that may allow opening and/or closing of the door 130 even if one or more dampers 161 fail, for example.

The oven 100 may include any number of dampers 161. For example, the oven 100 may include 1 damper 161, 2 dampers 161, 3 dampers 161, 4 dampers 161, 6 dampers 161, 8 dampers 161, or any other number of dampers 161. The number of dampers 161 included on the oven 100 may be based on the number of doors 130 included on the oven 100. For example, the oven 100 may include 1 damper 161 (e.g., a dual direction damper 161) for every 1 door 130 included on the oven 100. As another example, the oven 100 may include dampers 161 for every 1 door 130 included on the oven 100. As a further example, the oven 100 may include 4 dampers 161 for every 1 door 130 included on the oven 130. As illustrated, the oven 100 includes two dampers 161. When the oven 100 includes multiple dampers 161, all of the dampers 161 may resist movement of the door 130 in the same direction (e.g., open, closed, and/or both open and closed). Alternatively, one or more of the dampers 161 may resist movement of the door in an opposite direction of the other dampers 161. For example, one or more dampers 161 may resist movement of the door 130 in the direction of the opening of the door 130 (thereby preventing the door 130 from slamming open), and one or more of the other dampers 161 may resist movement of the door in the direction of the closing of the door 130 (thereby preventing the door 130 from slamming shut).

The damper 161 may be coupled to the frame 110. For example, the damper 161 may be coupled to the horizontal portion 113 of the bottom surface 111*f* of the frame 110 (as is illustrated with regard to damper 161*a*), the vertical portion 112 of the front surface 111*a* of the frame 110 (as is illustrated with regard to damper 161*b*), the side surfaces 111*b* and/or 111*d*, the top surface 111*e*, any other portion of the frame 110, or any combination of the preceding. The damper 161 may be coupled to the frame 110 in any manner. For example, the damper 161 may be bolted to the frame 110, screwed to the frame 110, riveted to the frame 110, clipped to the frame 110, welded to the frame 110, formed integral with the frame 110, coupled to the frame 110 in any other manner, or any combination of the preceding. The damper 161 may further be pivotally coupled to the frame 110, thereby allowing the damper 161 to pivot upward and downward (as is seen in FIG. 1E) as the counterweight 151 and the rear portion 143 of the hinge 141 pivot.

The damper 161 may further be coupled to the counterweight 151. For example, as is illustrated, the damper 161*a* may be coupled to the counterweight 151*a*, thereby coupling the counterweight 151*a* to the frame 110. The damper 161 may be coupled to the counterweight 151 in any manner. For example, the damper 161 may be bolted to the counterweight 151, screwed to the counterweight 151, riveted to the counterweight 151, clipped to the counterweight 151, welded to the counterweight 151, formed integral with the counterweight 151, coupled to the counterweight 151 in any other manner, or any combination of the preceding. The damper 161 may further be pivotally coupled to the counterweight 151, thereby allowing the damper 161 to pivot upward and downward (as is seen in FIG. 1E) as the counterweight 151 and the rear portion 143 of the hinge 141 pivot. Although the damper 161 is described as being coupled to the counterweight 151, the damper 161 may alternatively (or additionally) be coupled to the rear portion 143 of the hinge 141.

The damper 161 may be coupled to the frame 110 in any position on the frame 110. For example, the damper 161 may be positioned on either side of the oven chamber 120. In such an example, when the oven 100 includes multiple dampers 161, all of the dampers 161 may be positioned on the same side of the oven chamber 120, as is illustrated in FIG. 1A. Alternatively, when the oven 100 includes multiple dampers 161, one or more of the dampers 161 may be positioned on different sides of the oven chamber 120. In one example, it is preferable that all of the dampers 161 (such as dampers 161*a* and 161*b* of FIGS. 1A-1E) be positioned on the same side of the oven chamber 120 (as is illustrated in FIG. 1A). This may allow the lateral spacing (in-between the oven chamber 120 and the frame 110) that may be used to house the dampers 161 to be included on a single side of the oven chamber 120 (as opposed to divided up in-between two different sides). This may create a bigger lateral spacing on the frame 110, which may be used for a side control panel of the oven 100. It may also provide a single wide access service panel that may be used to access the dampers 161, if replacement of one or more dampers 161 is desired (or required). In such an example, all of the dampers 161 may, be accessed by, for example, removing the same side panel from the frame 110, or pulling the frame 110 and/or the oven 100 out of a cabinet (or other enclosure).

As is illustrated in FIGS. 1A-1E, the oven 100 includes 2 dampers 161. The first damper 161*a* may be a hydraulic extension damper coupled to the horizontal portion 113*a* of the bottom surface 111*f* of the frame 110, and further coupled to the counterweight 151*a*. For example, as is illustrated in FIG. 1E, the first damper 161*a* may include a first portion 162 coupled to the horizontal portion 113*a* of the bottom surface 111*f* of the frame 110, and a second portion 163 coupled to the counterweight 151*a*. The first portion 162 may be pivotally coupled to the horizontal portion 113*a* and the second portion 163 may be pivotally coupled to the counterweight 151, thereby allowing the damper 161 to pivot upward and downward (as is seen in FIG. 1E) as the counterweight 151 and the rear portion 143 of the hinge 141 pivot. As a hydraulic extension damper, the first damper 161 may resist movement of the door 130 in a direction of the opening of the door 130 (thereby preventing the door 130 from slamming open). In particular, as the door 130 opens, the counterweight 151*a* may pivot upwards, causing the pin of the first damper 161*a* to extend out of the tube of the first damper 161*a*. Furthermore, the first damper 161*a* may resist this extension, thereby resisting the movement of the door 130 in the direction of the opening of the door 130.

Alternatively, the second damper 161*b* may be a hydraulic compression damper coupled to the front surface 111*a* of the frame 110. For example, the second damper 161*b* may include a first portion 165 that is coupled to the front surface 111*a* and that extends from the front surface 111*a* towards the door 130. Furthermore, the second damper 161*b* may further include a second portion 166 that is coupled to the front surface 111*a* and that extends from the front surface 111*a* rearward away from the door 130 so as to be located within the frame 110. As a hydraulic compression damper, the second damper 161*b* may resist movement of the door 130 in the direction of the closing of the door 130 (thereby preventing the door 130 from slamming closed). In particular, as the door 130 closes, the door 130 may pivot upwards to contact the pin of the second damper 161*b*, causing the pin to compress into the tube of the second damper 161*b*. Furthermore, the second damper 161*b* may resist this compression, thereby resisting the movement of the door 130 in the direction of the closing of the door 130.

Modifications, additions, combinations, or omissions may be made to the oven 100 of FIGS. 1A-1E without departing from the scope of the disclosure. For example, the oven 100 may not include one or more of the features discussed above with regard to FIGS. 1A-1E. As another example, although the oven 100 has been illustrated as including only a first damper 161*a* and a second damper 161*b* positioned on the same side of the oven chamber 120, the oven 100 may also include a third damper and a fourth damper positioned on an opposite side of the oven chamber 120 from the first damper 161*a* and the second damper 161*b*. In such an example, the third damper may be coupled to the counterweight 151*b* and may resist movement of the door 130 in the direction of the opening of the door 130, and the fourth damper may resist movement of the door 130 in the direction of the closing of the door 130. As another example, although the second damper 161*b* has been illustrated as being coupled to the first surface 111*a* of the frame 110, the second damper 161*b* may additionally (or alternatively) be coupled to any of the other surfaces 111 of the frame 110, such as the horizontal portion 113*a* of the bottom surface 111*f* of the frame 110.

FIG. 2 illustrates an example method of manufacturing, installing, and/or using a kitchen oven. One or more of the steps (such as all of the steps) of method 200 may be performed using the oven 100 of FIGS. 1A-1E. Furthermore, one or more of the steps (such as all of the steps) of method 200 may be performed by a manufacturer of a kitchen oven, a re-seller of a kitchen oven, a shipper of a kitchen oven, an installer of a kitchen oven, a repairer of a kitchen oven, and/or a user of a kitchen oven. Additionally, one or more of the steps of method 200 may be performed by different entities. For example, a first entity (such as a manufacturer) may perform one or more of the steps, while a second entity (such as a user) may perform the remainder of the steps, for example.

The method 200 begins at step 205. At step 210, a frame 110 may be coupled to an oven chamber 120. The frame 110 may be coupled to the oven chamber 120 in any manner. For example, the frame 110 may be bolted to the oven chamber 120, screwed to the oven chamber 120, riveted to the oven chamber 120, clipped to the oven chamber 120, welded to the oven chamber 120, formed integral with the oven chamber 120, coupled to the oven chamber 120 in any other manner, or any combination of the preceding. By coupling the frame 110 to the oven chamber 120, the surfaces 111 of the frame 110 may encapsulate the oven chamber 120, so that the oven chamber 120 may be disposed entirely within the frame 110. Although the surfaces 111 of the frame 110 may encapsulate the oven chamber 120, the front opening 121 of the oven chamber 120 may remain unblocked by the surfaces 111 of the frame 110.

At step 215, a door 130 may be pivotally coupled to the frame 110. The door 130 may be pivotally coupled to the frame 110 using one or more hinges 141. The door 130 may be pivotally coupled to the frame 110 in any manner. For example, a front portion 142 of a hinge 141 may be disposed in-between (and coupled to) a door front surface 131 and a door rear surface 132, as is discussed above with regard to FIGS. 1A-1E. Additionally, a rear portion 143 of the hinge 141 may be inserted into (and extend rearward through) an opening 145 in a vertical portion 112 of the front surface 111*a* of the frame 110. Furthermore, a pivoting portion 144 of the hinge 141 may be coupled to the frame 110, thereby coupling the door 130 to the frame 110. For example, the pivoting portion 144 may be an axle or pin (such as a vertical axle) that may be inserted into a matching bore 116 in a tab 115 of the opening 145 of the front surface 111*a* of the frame 110. Insertion of the pivoting portion 144 into the matching bore 116 may allow the hinge 141 to pivot around an axis of the matching bore 116. As such, the door 130 (and the front portion 142 of the hinge 141) may pivot downward in order for the door 130 to be opened, and the door 130 (and the front portion 142 of the hinge 141) may pivot upward in order for the door 130 to be closed, for example.

At step 220, a counterweight 151 may be coupled to a hinge 141. For example, a counterweight 151 may be coupled to a rear portion 143 of a hinge 141. The counterweight 151 may be coupled to the hinge 141 in any manner. For example, the counterweight 151 may be bolted to the hinge 141, screwed to the hinge 141, riveted to the hinge 141, clipped to the hinge 141, welded to the hinge 141, formed integral with the hinge 141, coupled to the hinge 141 in any other manner, or any combination of the preceding. Additionally, any number of counterweights 151 may be coupled to any number of hinges 141 in accordance with step 220. For example, the counterweight 151*a* may be coupled to the hinge 141*a*, and the counterweight 151*b* may be coupled to the hinge 141*b*.

At step 225, a damper 161 may be coupled to the frame 110. For example, the damper 161 may be coupled to the horizontal portion 113 of the bottom surface 111*f* of the frame 110 (as is illustrated with regard to damper 161*a*), the vertical portion 112 of the front surface 111*a* of the frame 110 (as is illustrated with regard to damper 161*b*), the side surfaces 111*b* and/or 111*d*, the top surface 111*e*, any other portion of the frame 110, or any combination of the preceding. The damper 161 may be coupled to the frame 110 in any manner. For example, the damper 161 may be bolted to the frame 110, screwed to the frame 110, riveted to the frame 110, clipped to the frame 110, welded to the frame 110, formed integral with the frame 110, coupled to the frame 110 in any other manner, or any combination of the preceding. The damper 161 may further be pivotally coupled to the frame 110, thereby allowing the damper 161 to pivot upward and downward (as is seen in FIG. 1E) as the counterweight 151 and the rear portion 143 of the hinge 141 pivot.

The damper 161 may be coupled to the frame 110 in any position on the frame 110. For example, the damper 161 may be positioned on either side of the oven chamber 120. In such an example, when the oven 100 includes multiple dampers 161 all of the dampers 161 may be positioned on the same side of the oven chamber 120, as is illustrated in FIG. 1A. Alternatively, when the oven 100 includes multiple dampers 161, one or more of the dampers 161 may be positioned on different sides of the oven chamber 120.

In addition to coupling the damper 161 to the frame 110, step 225 may further include coupling the damper 161 to a counterweight 151. For example, as is illustrated, the damper 161*a* may be coupled to the counterweight 151*a*, thereby coupling the counterweight 151*a* to the frame 110. The damper 161 may be coupled to the counterweight 151 in any manner. For example, the damper 161 may be bolted to the counterweight 151, screwed to the counterweight 151, riveted to the counterweight 151, clipped to the counterweight 151, welded to the counterweight 151, formed integral with the counterweight 151, coupled to the counterweight 151 in any other manner, or any combination of the preceding. The damper 161 may further be pivotally coupled to the counterweight 151, thereby allowing the damper 161 to pivot upward and downward (as is seen in FIG. 1E) as the counterweight 151 and the rear portion 143 of the hinge 141 pivot.

Any number of dampers 161 may be coupled to the frame 110 (and/or to any number of counterweights 151). For example, a first damper 161*a* (such as a hydraulic extension damper) may be coupled to the horizontal portion 113*a* of the bottom surface 111*f* of the frame 110, and further coupled to the counterweight 151*a*. As such, the first damper 161*a* may resist movement of the door 130 in a direction of the opening of the door 130 (thereby preventing the door 130 from slamming open). Furthermore, a second damper 161*b* (such as a hydraulic compression damper) may be coupled to the front surface 111*a* of the frame 110, so that a first portion 165 of the second damper 161*b* extends from the front surface 111*a* towards the door 130. As such, the second damper 161*b* may resist movement of the door 130 in the direction of the closing of the door 130 (thereby preventing the door 130 from slamming closed). At step 230, the method 200 ends.

Modifications, additions, or omissions may be made to method 200. For example, the method 200 may further include coupling one or more surfaces 111 together so as to form the frame 110. Additionally, the steps of method 200 may be performed in parallel or in any suitable order.

This specification has been written with reference to various non-limiting and non-exhaustive embodiments or examples. However, it will be recognized by persons having ordinary skill in the art that various substitutions, modifications, or combinations of any of the disclosed embodiments or examples (or portions thereof) may be made within the scope of this specification. Thus, it is contemplated and understood that this specification supports additional embodiments or examples not expressly set forth in this specification. Such embodiments or examples may be obtained, for example, by combining, modifying, or reorganizing any of the disclosed steps, components, elements, features, aspects, characteristics, limitations, and the like, of the various non-limiting and non-exhaustive embodiments or examples described in this specification. In this manner, Applicant reserves the right to amend the claims during prosecution to add features as variously described in this specification.

What is claimed is:

1. An oven, comprising:
   a. an oven chamber operable to be heated, the oven chamber having a front opening;
   b. a frame coupled to and at least partially surrounding the oven chamber, the frame including a pair of vertical portions each being positioned on opposing lateral sides of the front opening;
   c. a door operable to seal the front opening of the oven chamber, the door extending laterally to at least the vertical portions of the frame;
   d. a pair of hinges pivotally coupling the door to the frame, the hinges each being positioned on opposing sides of the oven chamber, each hinge having:
      i. a front portion disposed in-between a front surface and a back surface of the door; and
      ii. a rear portion that extends rearward away from the door and through an opening in a respective vertical portion of the frame;
   e. a pair of counterweights that are each coupled to the rear portion of a respective hinge, wherein the rear portion of each of the hinges and each of the counterweights are configured to pivot when the door pivots; and
   f. a pair of dampers, each damper coupled to the frame and operable to resist movement of the door in a single direction opposite that of the other damper, wherein a first damper of the pair of dampers couples a first counterweight of the pair of counterweights to the frame.

2. The oven of claim 1, wherein the oven chamber is selected from a group consisting of:
   a. a gas oven chamber;
   b. an electric oven chamber;
   c. a wood-burning oven chamber;
   d. a charcoal-burning oven chamber; and
   e. a convection oven chamber.

3. The oven of claim 1, wherein the first damper of the pair of dampers is an extension damper.

4. The oven of claim 1, wherein a second damper of the pair of dampers is a compression damper.

5. The oven of claim 1, further comprising a second pair of dampers, each damper of the second pair of dampers being coupled to the frame and operable to resist movement of the door in a single direction opposite that of the other damper of the second pair of dampers, a first damper of the second pair of dampers coupling a second counterweight of the pair of counterweights to the frame.

6. The oven of claim 1, wherein each damper of the pair of dampers is positioned on the same side of the oven chamber.

7. The oven of claim 1, wherein each damper of the pair of dampers is positioned on opposing sides of the oven chamber.

8. The oven of claim 1, wherein the pair of counterweights have a combined weight that is equal to a weight of the door plus or minus 5 pounds.

9. The oven of claim 1, wherein the front portion of each hinge is positioned orthogonal to the rear portion.

10. A method, comprising:

a. coupling a frame to an oven chamber so that the frame at least partially surrounds the oven chamber, the oven chamber being operable to be heated, the oven chamber having a front opening, the frame having a pair of vertical portions that are each positioned on opposing lateral sides of the front opening;

b. pivotally coupling a door to the frame using a pair of hinges, the door being operable to seal the front opening of the oven chamber, the door extending laterally to at least the vertical portions of the frame, the hinges each being positioned on opposing sides of the oven chamber, each hinge having:

i. a front portion disposed in-between a front surface and a back surface of the door; and ii. a rear portion that extends rearward away from the door and through an opening in a respective vertical portion of the frame;

c. coupling each of a pair of counterweights to the rear portion of a respective hinge wherein the rear portion of each of the hinges and each of the counterweights are configured to pivot when the door pivots;

d. coupling a pair of dampers to the frame, each damper being operable to resist movement of the door in a single direction opposite that of the other damper; and e. coupling a first counterweight of the pair of counterweights to the frame using a first damper of the pair of dampers.

11. The method of claim 10, wherein the oven chamber is selected from a group consisting of:

a. a gas oven chamber;

b. an electric oven chamber;

c. a wood-burning oven chamber;

d. a charcoal-burning oven chamber; and e. a convection oven chamber.

12. The method of claim 10, wherein the first damper of the pair of dampers is an extension damper.

13. The method of claim 10, wherein a second damper of the pair of dampers is a compression damper.

14. The method of claim 10, further comprising:

a. coupling a second pair of dampers to the frame, each damper of the second pair of dampers being operable to resist movement of the door in a single direction opposite that of the other damper of the second pair of dampers; and b. coupling a second counterweight of the pair of counterweights to the frame using a first damper of the second pair of dampers.

15. The method of claim 10, wherein each damper of the pair of dampers is positioned on the same side of the oven chamber.

16. The method of claim 10, wherein each damper of the pair of dampers is positioned on opposing sides of the oven chamber.

17. The method of claim 10, wherein the pair of counterweights have a combined weight that is equal to a weight of the door plus or minus 5 pounds.

18. An oven, comprising:

a. an oven chamber operable to be heated, the oven chamber having a front opening;

b. a frame operatively coupled to support and at least partially surround the oven chamber;

c. a door operable to seal the front opening of the oven chamber, the door extending laterally to at least a pair of vertical portions of the frame;

d. a pair of hinges pivotally coupling the door to the frame, the hinges each being positioned on opposing sides of the oven chamber and in-between respective side portions of the frame and the oven chamber, each hinge having:

i. a front portion disposed in-between a front surface and a back surface of the door; and ii. a rear portion that extends rearward away from the door and through an opening in a respective vertical portion of the frame;

e. a first counterweight coupled to the rear portion of a first hinge of the pair of hinges wherein both the rear portion of the first hinge and the first counterweight are configured to pivot when the door pivots; and f. a first damper coupled to the frame and operable to resist movement of the door in at least a first direction, wherein the first damper couples the first counterweight to the frame.

19. The oven of claim 18, further comprising a second counterweight coupled to the rear portion of a second hinge of the pair of hinges.

20. The oven of claim 18, further comprising a second damper coupled to the frame and operable to resist movement of the door in a direction opposite of that resisted by the first damper.

21. The oven of claim 20, wherein the first damper and the second damper are each disposed in-between a side portion of the frame and the oven chamber.

22. The oven of claim 21, wherein the first damper is an extension damper pivotally coupled to a portion of the frame and a portion of at least one of the first counterweight and the rear portion of the first hinge of the pair of hinges, and wherein the second damper is a compression damper.

23. The oven of claim 22, wherein the extension damper and compression damper are disposed on the same side of the oven chamber.

24. The oven of claim 18, wherein the first damper is disposed in-between a side portion of frame and the oven chamber.

25. The oven of claim 18, wherein the first damper is an extension damper pivotally coupled to a portion of the frame and a portion of at least one of the first counterweight and the rear portion of the first hinge of the pair of hinges.

* * * * *